United States Patent [19]

Fontaine

[11] 4,323,872

[45] Apr. 6, 1982

[54] FUSE CARTRIDGES

[76] Inventor: Jean-Claude Fontaine, 5 rue des Gantries, Ecully, France, 69130

[21] Appl. No.: 864,906

[22] Filed: Dec. 27, 1977

[30] Foreign Application Priority Data

Jan. 21, 1977 [FR] France ..... 77 02679

[51] Int. Cl.[3] ..... H01H 85/04

[52] U.S. Cl. ..... 337/158; 337/231

[58] Field of Search ..... 337/227, 228, 229, 231, 337/233, 149, 234, 159, 158

[56] References Cited

U.S. PATENT DOCUMENTS 3,876,966 4/1975 Fister ..... 337/159

*Primary Examiner*—Harold Broome

*Attorney, Agent, or Firm*—Dowell & Dowell

[57] ABSTRACT

A fuse cartridge specifically designed to resist axial compressive forces is disclosed. The tubular body of the cartridge is reinforced by an insulating spacer between the heads of the cartridge which is capable of resisting such compressive forces. The spacer is normally located on the axis of the cartridge but may itself be tubular and surround the fusible elements if desired. The cartridge is particularly designed for mounting radially on a rotatable support with its outer end secured thereto and a fixing lug may be provided for this purpose. To compensate for the mass of the lug, a lateral cutaway is formed in the head from which it extends.

8 Claims, 7 Drawing Figures

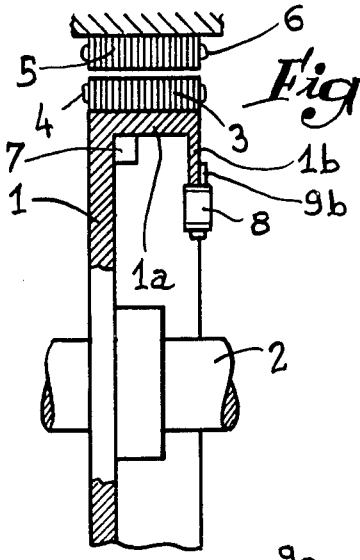
Fig. 1
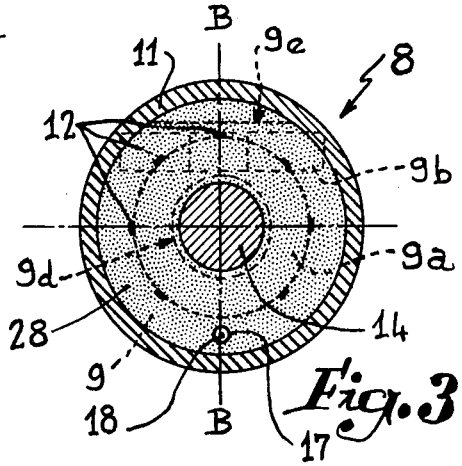
Fig. 3
Fig. 2
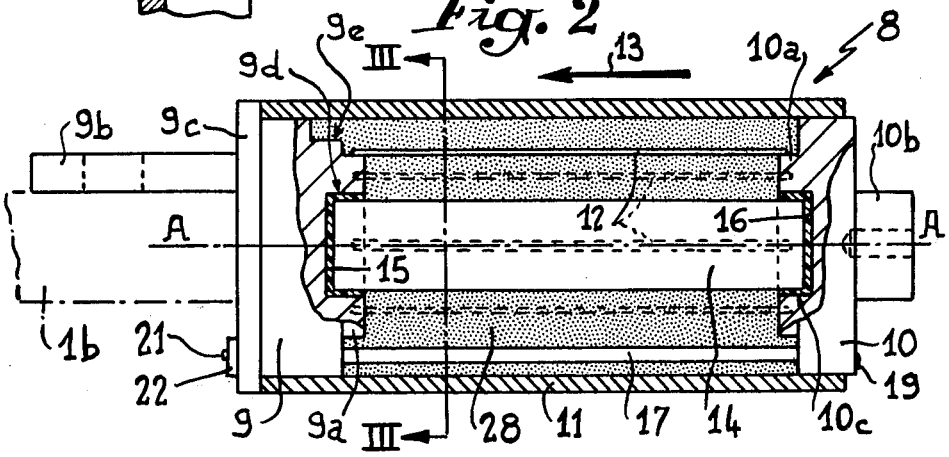
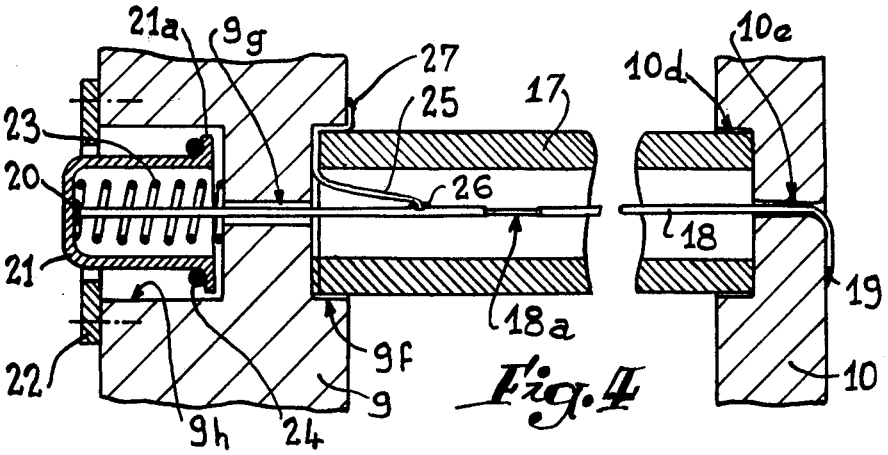
Fig. 4

FUSE CARTRIDGES

BACKGROUND TO THE INVENTION

The present invention relates to fuse cartridges in general, and more particularly those which are subjected during use to axially directed compressive stresses. For example, cartridges mounted radially on supports which rotate at high speed are subject to sometimes very high centrifugal accelerations.

It is known that in turbo-alternator sets the conventional excitation dynamo has been very often replaced by a small auxiliary polyphase alternator with a rotating armature and a fixed inductor which supplies the rotating inductor of the main alternator by way of semiconductor rectifiers. This dispenses with the commutator of the dynamo hitherto used and also the rings for transmitting its current to the rotor of the alternator. However, semiconductor rectifiers constitute relatively fragile elements which have to be protected, which is achieved by associating with them fuse cartridges, individually mounted on the various phases of the auxiliary alternator. These cartridges are in most cases fixed radially on an annular support integral with the armature of this alternator, so that the centrifugal acceleration to which they are subjected subjects them to axial compressive stresses. Such stresses are not very easily withstood by the conventional cartridges, which tend to become crushed or even to burst.

Experience also shows that the indicating devices associated generally with conventional cartridges, more particularly those of the button or "striker" type, are not very well adapted to resist centrifugal acceleration. Neither are they well suited to the very small voltages which appear at the terminals of a cartridge which has operated, in an auxiliary alternator of the aforesaid type comprising a large number of phases.

SUMMARY OF THE INVENTION

The invention aims to overcome the aforesaid disadvantages and make it possible to provide fuse cartridges capable of withstanding without damage substantial axial compressive stresses, particularly those resulting from high centrifugal acceleration. The invention also aims at providing such cartridges with a signalling or indicating device of the "striker" type which operates satisfactorily even in the presence of centrifugal accelerations, and even if the voltage at the terminals of the cartridge is relatively small.

According to the invention, a fuse cartridge comprises two metal heads mounted at the ends of a tubular insulating body, the heads being connected to one another within the body by a fusible element, and an insulating spacer interposed between the metal heads, which spacer is capable of resisting compressive forces applied between the ends of the cartridge. The spacer is preferably located on the axis of the tubular body, but it may itself be tubular in shape to surround the space in which the fusible element or elements are situated. In this latter case, the spacer is normally made in two semi-cylindrical pieces to facilitate assembly to the cartridge.

The cartridge of the invention is particularly designed for mounting radially on a rotatable support with its outer end secured thereto, and to resist axial compressive stresses resulting from centrifugal accelerations generated by rotation of the support. A peripheral flange is preferably provided on the head which is furthest from the centre of rotation so as to form an abutment arresting the external insulating body of the cartridge independently of any other means for fixing the said body. The cartridge may also be provided with a striker arranged longitudinally and directed in such a manner that its button is urged in the releasing direction under the action of centrifugal acceleration, the button being retained in position by a fusible wire comprising a zone of reduced cross-section of very short length.

BRIEF DESCRIPTION OF THE DRAWINGS

The invention will now be described by way of examples of embodiments thereof and with reference to the accompanying drawings wherein:

FIG. 1 is a partial axial section showing schematically an auxiliary alternator forming the exciter of a turbo-alternator set;

FIG. 2 is an axial section through a fuse cartridge according to the invention to be associated with the auxiliary alternator of FIG. 1;

FIG. 3 is a section taken on line III—III of FIG. 2;

FIG. 4 is a detail view in longitudinal section on a large scale of the striker device included in the cartridge shown in FIGS. 2 and 3;

DESCRIPTION OF PREFERRED EMBODIMENTS

Figure 5:
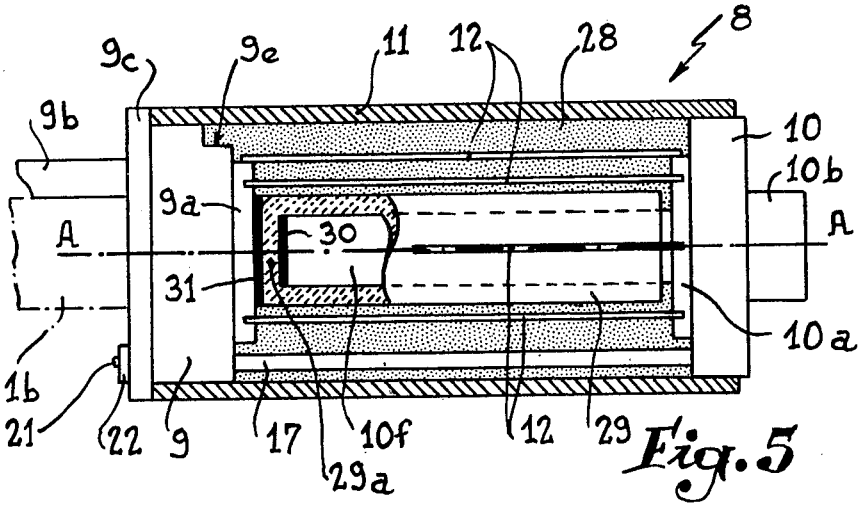
FIGS. 5 and 6 are axial sections similar to that of FIG. 2 but illustrating modified embodiments of the invention.

FIG. 1 illustrates schematically a section through an exciter for a turbo-alternator set. This machine comprises a support wheel 1 which is mounted on the shaft 2 of the set. The wheel 1 is integral with a rim 1*a* which comprises an annular armature 3 of divided metal plates with which there are associated windings such as 4. This armature rotates within a fixed inductor 5 which may comprise either permanent magnets or an inductor winding 6. The alternating voltages which appear in the armature windings 4 are rectified by semiconductor rectifiers such as 7, suitably fixed to the wheel 1. Also in order to protect the machine in general it has been provided with cartridges with fuses 8 which in the example illustrated are fixed in an internal flange 1*b* integral with the rim 1*a*. Of course the cartridges 8 rotate with the shaft 2 and consequently are subjected to centrifugal acceleration which tend to compress them in their axial direction. These accelerations may reach values such that the usual cartridges no longer withstand the stress and crush on themselves.

In the constructional form shown in FIGS. 2 and 3 the cartridge, given the general reference numeral 8, as in FIG. 1, comprises in the usual way two metal heads 9 and 10 mounted in the respective ends of an insulating tubular body 11 and fixed thereto by means not shown here (screws for example), these heads being provided with internal bosses 9*a*, 10*a* to which there are welded the ends of a certain number of fusible conductors 12 arranged for example in the form of strips. The head 9 is integral with a perforated external lug 9*b* offset laterally relative to the longitudinal axis A—A of the cartridge and by means of which the latter can be fixed to a suitable support indicated in broken lines, which can be assumed to be constituted by the flange 1*b* of FIG. 1. This support, which is centred on the axis A—A, thus constitutes the earth electrode, the windings 4 and the rectifiers 7 being assumed to be connected in a star arrangement. Under these conditions the centrifugal force tends to compress the entire cartridge axially against the support 1*b* (direction indicated by the arrow 13 in FIG. 2).

In order to hold the body 11 against the centrifugal acceleration represented by the arrow 13, the head 9 is provided with an annular flange 9*c* which projects and is adapted to form an abutment.

The head 10 is constructed so as to receive a suitable connecting wire. In the illustrated embodiment the head comprises an external boss 10*b* suitably perforated for this purpose. To hold it against the centrifugal acceleration there is provided between it and the head 9, within the cartridge, an axial spacer 14 made of an insulating material having good mechanical strength properties for resisting compression. The ends of this spacer engage with considerable clearance within corresponding depressions 9*d* and 10*c* provided in the heads, the aforesaid clearance being filled with a layer 15 or 16 respectively of a substance suitable to constitute a cushion for distributing forces. The substance in question can be constituted by for example, a non-brittle adhesive or a layer of relatively deformable plastics material.

Furthermore, as FIG. 3 shows, the head 9 is provided with a transverse peripheral cutaway 9*e* bounded by a bottom surface of rectilinear outline and which extends over a portion of the thickness of the head, this cutaway being centred relative to the transverse axis of symmetry B—B of the lug 9*b*. The cutaway 9*e* is provided so as to compensate for the imbalance which the off-axis setting of the lug 9*b* produces in the distribution of masses about the general longitudinal axis of the cartridge. In other words, because of the provision of this cutaway, the centre of gravity of the head 9 is located on the longitudinal axis A—A so that the forces resulting from centrifugal acceleration on the said head provide a component situated on this axis.

The cartridge shown in FIGS. 2 and 3 also comprises an operation indicating device of the type known as a "striker" that is to say comprising a button which is normally retained within the cartridge but issues from the cartridge when the latter has operated.

As detailed in FIG. 4, the device in question comprises an insulating tube 17 engaged with a certain amount of clearance in two corresponding interal recesses 9*f* and 10*d* of the heads 9 and 10. Within this tube there is arranged an axial fuse wire 18 of small cross-section, one end of which extends through a perforation 10*e* of the head 10 and is welded thereto as indicated at 19, whilst the other end passes through a suitable perforation 9*g* of the head 9 and is welded at 20 to the end of the button or "striker" 21 which is hollow and is held in a recess 9*h* provided on the external face of the aforesaid head 9. The button 21 is guided by a washer 22 fitted against the said head 9. It is urged in the direction of the exterior by a light spring 23. It is also surrounded by a sealing ring 24 which bears against a flange 21*a* surrounding its open end. To provide an electrical connection between the wire 18 and the head 9 without bringing the spring 23 into play, there has been provided a flexible shunt 25 welded to the aforesaid wire at 26 and to the internal face of the head 9 at 27, this shunt extending through the clearance provided between the tube 17 and the housing 9*f*. The location of the "striker" in the cartridge is indicated by the references 17, 19, 21 and 22 in FIG. 3.

Moreover, so that the wire 18 can melt easily even under very low voltages, such as those which occur in a layout of the type shown in FIG. 1, when a short-circuit appears on one phase of a polyphase system with a high number of phases, there has been formed on this wire a zone 18*a* of reduced cross-section extending over a very short length. In a preferred constructional form, this zone is obtained by starting with a fine wire on which metal is deposited by an electrolytic process, or another process, but omitting the aforesaid zone 18*a*.

All the internal space of the body 11 which surrounds the fuses 12, the spacer 14 and the tube 17, is filled with a mass 28 of a substance in powder form which is capable of extinguishing the arc. However, to avoid this substance behaving more or less in the manner of a liquid and therefore, under the action of centrifugal acceleration, tending to burst the body 11, it has been agglomerated by means of a binding agent of suitable type which transforms it into a porous mass which is capable of allowing the expansion of gases when the fuses break.

It will be understood that the cartridge shown in FIGS. 2 to 4 is capable of withstanding considerable compressive stresses, more particularly those resulting from centrifugal or other accelerations directed axially in the direction of the head 9, the body 11 bearing against the flange 9*c* and the head 10 against the spacer 14. All the forces are thus transmitted to the head 9, which transmits them directly to the support 1*b*. This cartridge also comprises a striker directed so that the axial acceleration tends to drive its button out towards the exterior.

In the embodiment shown in FIG. 5, the spacer provided between the two heads 9 and 10 comprises a core 10*f* made in one piece with the head 10 and consequently made of metal like the head. Mounted on this core is an insulating sleeve 29 which covers it over almost all its length, the end 29*a* of this sleeve being clamped between the free end of the core and the central portion of the boss 9*a* of the head 9. Here again in order to distribute forces, plastics material washers 30 and 31 have been interposed at the two sides of the end 29*a*. A depression such as 9*d* (FIG. 2) is no longer provided for centering the spacer assembly 10*e*–29, since the core 10*f* is rigidly integral with the head 9, but there is no reason why such a depression should not be used if it is thought to be useful.

It will be understood that because of the insulating covering effected by the sleeve 29, the spacer shown in FIG. 5 behaves substantially like that of FIGS. 2 and 3.

Figure 6:
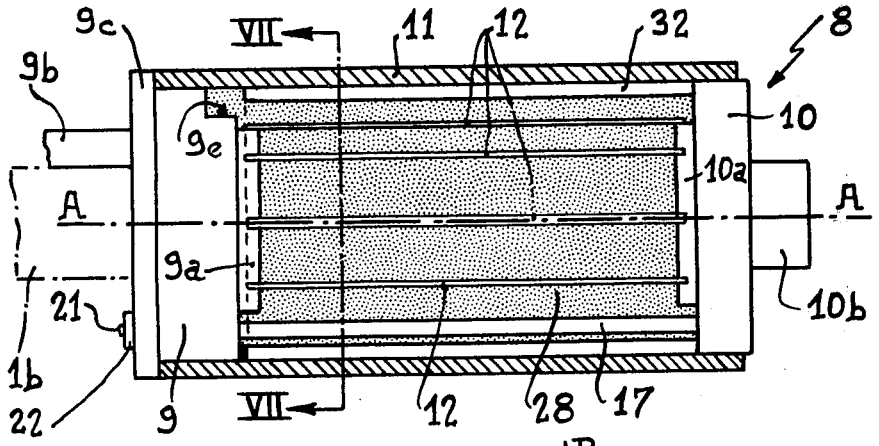
Figure 7:
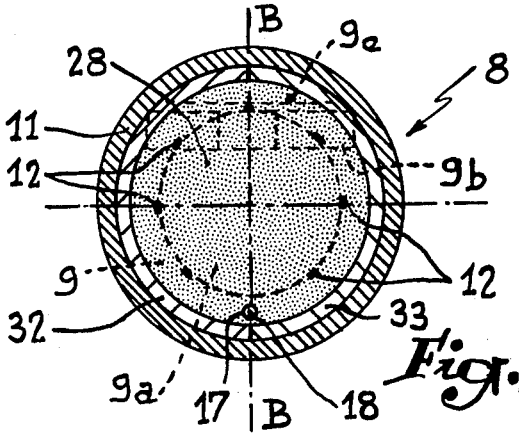
FIG. 7 is a section taken on line VII—VII of FIG. 6.

The embodiment shown in FIGS. 6 and 7 no longer comprises a central spacer such as 14 or 10*f*–29. To transmit forces between the two heads there has been provided within the body 1 a kind of sleeve interposed between the peripheral zones of the said heads and which can be regarded, therefore, as a tubular spacer. To allow the assembly of the cartridge, this sleeve is made in two semi-cylindrical portions 32 and 33 with a longitudinal joint plane passing through the axis A—A of the cartridge. In FIGS. 6 and 7 this plane has been assumed to coincide with the plane of symmetry B—B of the cutaway 9*e* (FIG. 6).

It will be noted that in order to simplify, each end of the sleeve 32–33 corresponds to a single transverse plane. As a result in FIG. 6 the left-hand edge of this sleeve does not extend into the cutaway 9*e* but by reason of the small transverse surface of the latter, this is of no importance in actual practice.

I claim:

1. A fuse cartridge adapted to be mounted on a support rotatable about a shaft, comprising:

a tubular insulating body having first and second ends, said tubular body having an axis normally disposed radially of the shaft of said rotatable support;

a first metal head at one end of said body, said first head including outwardly extending means for attachment to said rotatable support;

a second metal head at the other end of said body, said first and second heads having axially spaced inner surfaces facing each other;

insulated spacer means disposed axially within said tubular insulating body, said spacer means having a first end supported against the inner surface of said first metal head and having a second end supported against the inner surface of said second metal head, to oppose centrifugal forces and maintain said heads spaced from each other during rotation of said support, the diameter of said spacer means being small as compared with the inner diameter of said tubular insulating body, and said spacer means defining with said tubular insulating body a continuous intermediate annular space whose volume is larger than the volume within the outside diameter of the spacer means;

a plurality of elongated fusible electrical conductor elements disposed in circumferentially spaced relationship within said continuous annular space and having opposite ends electrically connected with said first head and with said second head; and a mass of arc quenching material surrounding said fusible elements and filling said continuous annular space.

2. In a fuse cartridge as claimed in claim 1, said spacer means being entirely made of insulating material.

3. In a fuse cartridge as claimed in claim 1, said spacer means comprising:

an elongated metallic core having first and second ends;

a first cap and a second cap made of insulating material and shaped to cover said first and said second ends of said core and operative to prevent electrical conduction between said core and said first and second heads while resisting compressive forces between said heads.

4. In a fuse cartridge as claimed in claim 1, said spacer means comprising:

an elongated metallic core having one of its ends integral with the inner surface of one of said heads;

and an insulating sleeve surrounding said metallic core, said sleeve having a closed end covering the other end of the core and interposed between said other end and the surface of the other of said heads to prevent electrical conduction between said metallic core and the other head.

5. In a fuse cartridge as claimed in claim 1, at least one of the ends of said spacer means being centered in a central depression in the inner surface of one of said heads.

6. In a fuse cartridge as claimed in claim 1, said mass including a quantity of binder sufficient to agglomerate the mass to such a degree as to inhibit flow thereof under the action of centrifugal forces while preserving the gas-pervious character of said mass.

7. In a fuse cartridge as claimed in claim 1, said first head having an annular shoulder abutting the first end of said tubular body and operative to prevent radial displacement of the body under the action of centrifugal forces.

8. In a fuse cartridge as claimed in claim 1, the attachment means of said first head comprising a mounting lug disposed externally of said tubular body, parallel to and offset from the axis of said body to permit said first head to bear at its center against said support, the first head having a portion thereof laterally cut away internally of said tubular body to compensate for the mass of said lug and locate the center of gravity of said first head substantially on the axis of said tubular body.

* * * * *